United States Patent [19]

Basting

[11] Patent Number: 4,690,402

[45] Date of Patent: Sep. 1, 1987

[54] TENSILE EXERCISE DEVICE

[76] Inventor: Jack A. Basting, 1945 E. Ivy St., St. Paul, Minn. 55119

[21] Appl. No.: 937,197

[22] Filed: Dec. 2, 1986

[51] Int. Cl.[4] ..... A63B 21/02

[52] U.S. Cl. ..... 272/137; 272/DIG. 4; 272/142

[58] Field of Search ..... 272/93, 94, 135-139, 272/142, 143, DIG. 4

[56] References Cited

U.S. PATENT DOCUMENTS

| | | | |
|---|---|---|---|
| 1,633,124 | 6/1927 | Noe . | |
| 1,638,003 | 8/1927 | Neumann . | |
| 1,706,654 | 3/1929 | Christesen | 272/137 |
| 1,717,861 | 6/1929 | Washburn . | |
| 1,749,544 | 3/1930 | Pagano . | |
| 1,866,024 | 7/1932 | Gailey | 272/137 |
| 1,870,750 | 8/1932 | Reach . | |
| 1,884,392 | 10/1932 | Treat . | |
| 1,945,134 | 1/1934 | Brunk | 272/79 |
| 3,062,543 | 11/1962 | Shaboo et al. . | |
| 3,312,466 | 4/1967 | Melchiona . | |
| 4,040,620 | 8/1977 | Friedman | 272/137 |
| 4,204,674 | 5/1980 | Ogland | 272/126 |
| 4,335,875 | 6/1982 | Elkin | 272/70 |
| 4,565,367 | 1/1986 | Kaiser | 272/126 |
| 4,570,929 | 2/1986 | Shoemaker | 272/137 |

FOREIGN PATENT DOCUMENTS

| | | | |
|---|---|---|---|
| 559138 | 9/1923 | France | 272/94 |
| 2245272 | 3/1974 | German Democratic Rep. | 272/136 |

*Primary Examiner*—Richard J. Apley
*Assistant Examiner*—J. Welsh
*Attorney, Agent, or Firm*—Merchant, Gould, Smith, Edell, Welter & Schmidt

[57] ABSTRACT

Disclosed is an exercising device (10) for performing tension exercises. The invention comprises a central longitudinal strap (15), enclosed by a padded sheath (11), with elastic bands (13) and rubber grip members (12) on each end. The grip members (12) are compressible, and the elastic bands (13) provide elastic resistance for developing muscle strength. The length of the elastic bands (13) is easily adjustable, and bands (13) of different resistance can be substituted as desired.

9 Claims, 4 Drawing Figures

TENSILE EXERCISE DEVICE

BACKGROUND OF THE INVENTION

1. Field of the Invention

The present invention relates to a tensile exercising device and, more particularly, to a portable exercising device which may be extended during use by a person in order to provide elastic resistance, thereby developing muscle strength.

2. Discussion of Related Technology

Many elastic exercising devices have been developed which can stretched, pulled or extended by a user in order to develop and maintain body muscles. Often, these devices use a series of tightly coiled springs having handles attached at opposite ends. When the handles are pulled apart, the spring is extended and provides resistance, which is overcome by the force produced by the person utilizing the exercising device. The springs are stretched and relaxed repeatedly during a single exercising session. There are several drawbacks of spring-based devices: they are heavy, difficult to store and transport; they present an unappealing, mechanical appearance; and they are uncomfortable when brought into contact with the human body. Furthermore, because of the mechanical nature of the device, construction tends to be complicated.

In addition, the handles of such devices must be made of a relatively rigid material in order to properly interface with the other mechanical portions of the device. These rigid handles become slippery due to perspiration and make it difficult for the user to maintain a constant and secure grip on the apparatus. If the grip is lost when the springs are in an extended position, injury to the user and damage to the equipment may result.

Other tensile exercising devices use rubber or other elastic materials which have handles fastened at opposite ends. While such devices are generally more portable than spring-based devices, the handles are still typically made of a rigid material in order to facilitate attachment, with the accompanying problems in maintaining a proper grip noted above. Alternatively, the handles are an integral portion of the complete device, so that when the handle fails or develops a defect, the entire unit must be replaced. Also, both the rigid handles and handles formed from loops of material tend to be uncomfortable to the user, and do not allow the user to exercise the muscles in the lower arms, hands, and fingers.

Another problem common to previous tensile exercising devices is the inability to conveniently adjust either the amount of elastic resistance or the size of the handles according to the size and strength of the user. Typically, these devices are either difficult for a beginner to use, or easily manipulated by a person already possessing well-developed muscles, thereby minimizing the beneficial effect of the device. Further, the previous devices do not allow the user to conveniently adjust the length of the device according to the user's size and the exercise to be performed.

SUMMARY OF THE INVENTION

The present invention is designed to provide a tensile exercising device which addresses many of the difficulties present in prior elastic exercising devices.

The general purpose of the present invention, which will be subsequently described in greater detail, is to provide a tensile exercising device which is portable, adjustable, attractive and comfortable.

In its preferred form, the tensile exercising device of the present invention includes a central, longitudinal, fabric strap member. The strap is encased in a leather or vinyl padded sheath. Because the exercising device is padded and relatively flexible, it is comfortable when it comes in contact with the body. Also, the leather or vinyl sheath is attractive, so that the device can in effect be worn by the user around his shoulders or waist before or after exercising. Further, the manufacturer is able to print his trademark or other writing on the padded sheath. The device can be easily folded and is portable enough to fit inside a small bag.

The invention also includes a pair of contoured, molded grip members which conform to the shape of the human hand, and which may be compressed by the strength of a human hand. These compressible grip members allow the user to exercise the muscles in the lower arms, hands, and fingers, thereby enhancing the overall exercise facilitating function of the device. Another advantage of the rubber grip members is that they tend to absorb perspiration and are not slippery, thereby preventing potential injuries. The grip members are connected to the central strap member and to the padded sheath by a pair of elastic bands.

The exercising device is readily adjustable, both in terms of length and resistance. The ends of the central strap member are fitted with a pair of O-rings confined within a loop formed from the strap member. One end of each elastic band is formed as a flexible tab with ribs, and the tabs are threaded through the O-rings. The O-rings enable the user to easily vary the length of the elastic band according to the size of the user, the desired resistance, and the exercise to be performed. The O-rings also enable the user to quickly and conveniently remove an elastic band and replace it with another elastic band of different resistance. The ends of the padded sheath fold back to permit easy access to the O-rings when an adjustment is desired.

The device is capable of being used for a variety of different exercises to strengthen different parts of the body. Also, the device can be used in combination with another exercise, for example, while running, biking, or aerobic dancing. This enables the user to exercise both the upper and lower portions of the body at the same time.

These features along with other advantages will become subsequently apparent, based on the details of construction and operation as more fully described hereinafter, reference being made to the accompanying drawings, wherein like numerals refer to like parts throughout.

DESCRIPTION OF THE PREFERRED EMBODIMENT

Figure 1:
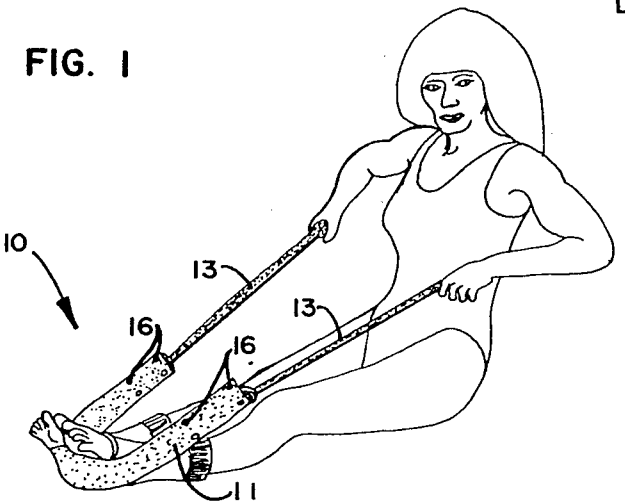
FIG. 1 is a perspective view of the present invention illustrating the invention being utilized in its operational environment.

FIG. 1 of the drawings illustrates the tensile exercise device in use. The device is capable of being used for a variety of different exercises to exercise various parts of the body, including arm curls, arm spreads, neck raises, shoulder shrugs, and bicep curls.

Figure 4:
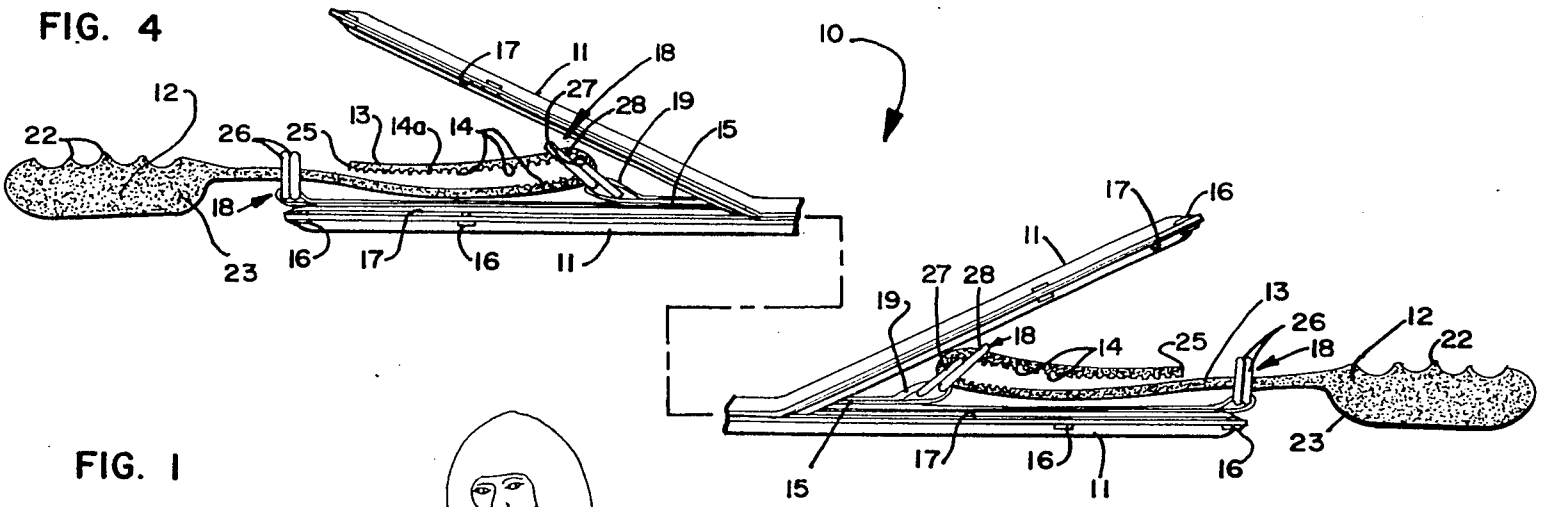
FIG. 4 is the side elevation of the device shown in FIG. 1 with a portion of each end partially dismantled, showing the details of the construction and adjustment.
Figure 2:
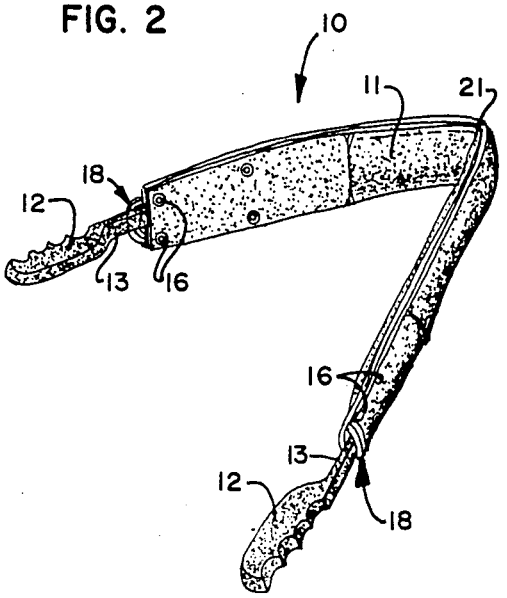
FIG. 2 is a perspective view of the device shown in FIG. 1.
Figure 3:
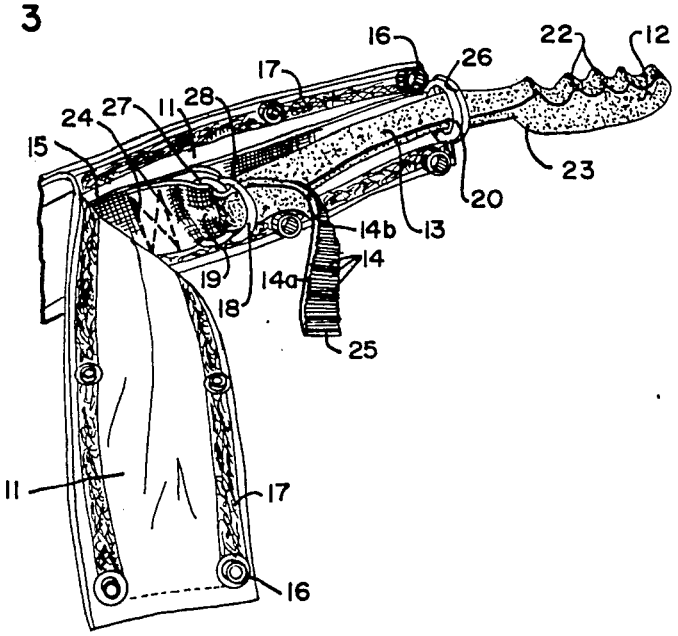
FIG. 3 is a partial perspective view showing one end of the device pictured in FIG. 1, one end of the device being partially dismantled to show details of construction.

FIGS. 2 through 4 of the drawings illustrate the portable tensile exercising device 10 made in accordance with and embodying the principles of the present invention. The exerciser 10 includes a central longitudinal strap member 15 which is preferably made of a strong nonelastic fabric material. The strap member 15 is completely encased within two strips of padded sheath 11. The padded sheath 11 comprises a strip of padding (not shown) surrounded on both side by a durable material. This material is preferably leather or vinyl, so that the device is attractive and comfortable. In the preferred embodiment, the length of the padded sheath is approximately thirty-five inches (35") and the width is approximately four inches (4").

On each end of the tensile exercising device 10 is a rubber grip member 12. These two grip members 12 are contoured to conform to the size of the hand of the person using the device. The grip member is provided with a plurality of ridges 22 for comfortable placement of the fingers. The grip members also have a fillet 23 of sufficient width to serve as a base for the grip member 12. Grip members 12 of various sizes can be used with the exercising device 10 and are readily interchangeable to conform to the size of the user's hand.

In the preferred embodiment, the grip members 12 are an integral part of a pair of elastic bands 13. Alternatively the grip members 12 may be suitably connected to the elastic bands 13. Each elastic band 13 has at its inner end a plurality of ribs 14 which facilitate a secure connection with the O-rings 18. The elastic bands 13 are connected to the central longitudinal strap member 15 by means of O-rings 18 located near each end of the strap member 15. The O-rings 18 are connected to the strap member 15 by means of a loop 19 in the material of the strap member 15. The loop 19 is fastened to the strap member 15 by means of sewn stitches 24. The O-rings 18 are preferably made of metal. In the preferred embodiment, there are a total of four pairs of O-rings 18, each pair being confined within a single loop 19.

In operation, the exercising device 10 can be easily adjusted. Adjustments can be made in the length of the device by moving the position of the elastic bands 13 relative to the O-rings 18, and adjustments in the device's resistance can be made by substituting elastic bands 13 of different resistance. To gain access to the O-rings 18, the user would fold back the ends of the padded sheath 11 from the longitudinal strap member 15. Each padded sheath 11 is connected to the opposite padded sheath 11 by means of a plurality of snaps 16 and a strip 17 of detachable gripping elements on cloth material, commonly known as Velcro TM. The snaps 16 and Velcro TM 17 are located on the inside of each padded sheath 11, along the longitudinal edges of each padded sheath 11. The strip of Velcro TM 17 and snaps 16 extend from each end of the padded sheath 11 to a sufficient distance behind the inner O-rings 18 to provide easy access to the O-rings 18.

The end 25 of the elastic band 13 is first inserted through both of the outer O-rings 26, which serve as a guide for the elastic band 13. The end 25 is then threaded through both of the inner O-rings 27 and 28. The end 25 is looped around the O-ring 27 and threaded under the O-ring 28, as best shown in FIG. 3. In the preferred embodiment, the distance between the O-rings 26 and the inner O-rings 27 and 28 is approximately eight inches (8"). The length of the elastic band 13 is adjusted as desired; when the desired length is at a maximum, the ribs 14*a* will be proximate to the inner O-rings 27 and 28, and when the length of the elastic band 13 is at a minimum, the ribs 14*b* will adjoin the inner O-rings 27 and 28. If a very long length is desired, the elastic band can be threaded as explained above through the outer O-rings 26, and the inner O-rings 27 and 28 would not be used. When the desired length is achieved, the grip member 12 is pulled until the ribs 14 of the elastic band 13 is tightened against the O-rings 27 and 28 and positioned securely. The two strips of padded sheath 11 are then folded back together, and each sheath 11 is connected to the other one with the snaps 16 and Velcro TM 17.

While a preferred embodiment of the invention and a manner of making it has been shown and described, it should be apparent that many modifications can be made without departing from the spirit and scope of the invention. Accordingly, the invention is not limited by the foregoing description, but is only limited by the scope of the claims.

I claim:

1. A tensile exercising device for performing tension exercises, comprising:

(a) a central, longitudinal, nonelastic strap member;

(b) a pair of elastic bands, each band having an inner and outer end, and each band being connected at its inner end to opposite longitudinal ends of said elongated strap member;

(c) a pair of rubber grip members connected to said outer ends of said elastic bands; and (d) adjusting means for adjusting the length of said elastic bands to vary with the size of the person using said device and with the exercise to be performed; and (e) two substantially flat strips of padded sheath which encase said strap member and said adjusting means and which have ends that include means to attach each strip of said padded sheath to each other so that the ends fold back from said strap member inorder to access said adjusting means.

2. The tensile exercising device of claim 1, wherein said means for adjusting the length of said elastic bands comprises:

(a) a pair of O-rings positioned near each end of said central strap member through which said inner end of the adjoining elastic band is threaded;

(b) a loop formed from said central strap member which confines said pair of O-rings and attaches said O-rings to said strap member; and (c) a plurality of ribs formed in said elastic bands to securely tighten against said O-rings.

3. The tensile exercising device of claim 2, wherein said pair of O-rings comprises:

(a) an outer pair of O-rings, through which said elastic band is threaded, which serves as a guide; and (b) an inner pair of O-rings having a first and second ring, wherein said elastic band is threaded through both said first and second rings and is looped around said first ring and under said second ring.

4. The tensile exercising device of claim 1, wherein each elastic band and grip member comprise a single integral rubber member.

5. The tensile exercising device of claim 1, wherein said two strips of padded sheath are attached to each other and to said strap member by sewn seam lines in the central portion of said exercising device.

6. The tensile exercising device of claim 1, wherein said means to attach said two strips of padded sheath to each other comprises a plurality of snaps so that said ends of said strips can be folded back for easy access to said O-rings.

7. The tensile exercising device of claim 1, wherein said means to attach said two strips of padded sheath to each other comprises strips of detachable gripping elements of cloth material so that said ends of said strips can be folded back for easy access to said O-rings.

8. The tensile exercising device of claim 1, wherein said elastic bands can be easily removed and replaced with elastic bands of different resistance to vary with the strength of the person using said device and with the exercise to be performed.

9. The tensile exercising device of claim 1, wherein said grip members have a plurality of ridges and are contoured to conform to the size of the hand of the person using said device.

* * * * *